United States Patent [19]

Uchida

[11] 4,277,119

[45] Jul. 7, 1981

[54] COVER FOR COUNTING ZONE IN NOTE COUNTER

[75] Inventor: Shinya Uchida, Tokyo, Japan

[73] Assignee: Laurel Bank Machine Co., Ltd., Tokyo, Japan

[21] Appl. No.: 931,903

[22] Filed: Aug. 8, 1978

[30] Foreign Application Priority Data

Aug. 8, 1977 [JP] Japan ..... 52-105995[U]

[51] Int. Cl.[3] ..... A47B 63/00; B42F 17/00

[52] U.S. Cl. ..... 312/208; 312/138 R; 312/183; 312/349; 271/95; 49/207

[58] Field of Search ..... 312/183, 186, 188, 190, 312/191, 196, 198, 3, 138 R, 301, 304, 208, 284, 134, 349; 49/370, 207; 271/186, 95, 98

[56] References Cited

U.S. PATENT DOCUMENTS

| | | | |
|---|---|---|---|
| 351,533 | 10/1886 | Shaw | 49/370 |
| 688,007 | 12/1901 | Robinson et al. | 49/207 |
| 2,662,528 | 12/1953 | Herzog | 312/183 |
| 2,697,647 | 12/1954 | Stingl et al. | 312/183 |
| 2,880,878 | 4/1959 | Collette | 312/134 |
| 2,888,307 | 5/1959 | Graves et al. | 312/284 |
| 2,964,183 | 12/1960 | Mathews | 312/349 |
| 2,967,748 | 1/1961 | Dreiling | 312/349 |
| 3,084,932 | 4/1963 | Schiller et al. | 271/186 |
| 3,729,243 | 4/1973 | Musgrave et al. | 312/138 R |
| 4,085,864 | 4/1978 | Gordon | 312/208 |

*Primary Examiner*—Victor N. Sakran

*Attorney, Agent, or Firm*—Fleit & Jacobson

[57] ABSTRACT

A cover is provided on a note counter so that the cover provides a covering on a counting zone which is located on the top portion of the note counter and in which the number of a bundle of notes packed in a holder is counted. The cover is made of a transparent material for inspection and comprises two covering members which are driven so as to move in opposite directions.

4 Claims, 5 Drawing Figures

COVER FOR COUNTING ZONE IN NOTE COUNTER

The present invention relates to the provision of a cover for the counting zone in a note counter.

BACKGROUND OF THE INVENTION

Conventional note counting machines are not provided with a cover or a shutter for covering the counting zone. The reason for not providing a cover has been that the provision of a cover would obviously result in inconvenience when bundles of notes are inserted into and removed from the counting zone, one after another. The cover would also decrease the efficiency of their operation.

However, because of the lack of a cover, the conventional note counting machine has been burdened with two main disadvantages. Firstly, the counting machine produces a relatively loud noise in the counting zone, and this noise is annoying to the operator and other persons nearby. Secondly, dust on the notes escapes into the surrounding air during the counting operation, thus degrading the environment in the vicinity of the machine. In order to prevent the dust from escaping from the counting zone, the conventional note counting machine is provided with a dust collecting device which collects the dust generated in the counting zone. However, the dust collecting device can collect only a part of the dust. Therefore, it is not satisfactory.

SUMMARY OF THE INVENTION

In a note counter, in which the number of a bundle of notes packed in a holder is counted by turning over the notes one by one by a plurality of rotary suction shaft, the present device provides a cover for the counting zone having a simple structure, in which the counting operation can be inspected from the outside to ensure safety in the operation, and a good covering state can be attained while reducing the movement range of the cover in a relatively narrow portion of the holder and diminishing the space for the cover members.

Therefore, one object of the present invention is to provide a novel counting machine with a cover which functions to shut noise generated in the counting zone and to prevent the dust from escaping from the counting zone.

A further object of the present invention is to provide a counting machine of the above type, in which almost the same level of effectiveness in operation can be obtained as is obtained in conventional machines.

In accordance with the present invention, there is provided a note counter in which the number of a bundle of notes packed in a holder is counted, the device comprising a frame provided with an open counting zone, a cover for covering the open counting zone and further comprising two transparent cover members disposed side by side, front guide means for guiding each of front portions of said cover members, rear guide means for guiding each of rear portions of said cover members, and means for driving the two transparent cover members so as to move them in opposite directions, separating them from each other and then joining them together.

Other objects and advantages of the present invention will become apparent from the following description made with reference to the accompanying drawings.

DETAILED DESCRIPTION

Figure 1:
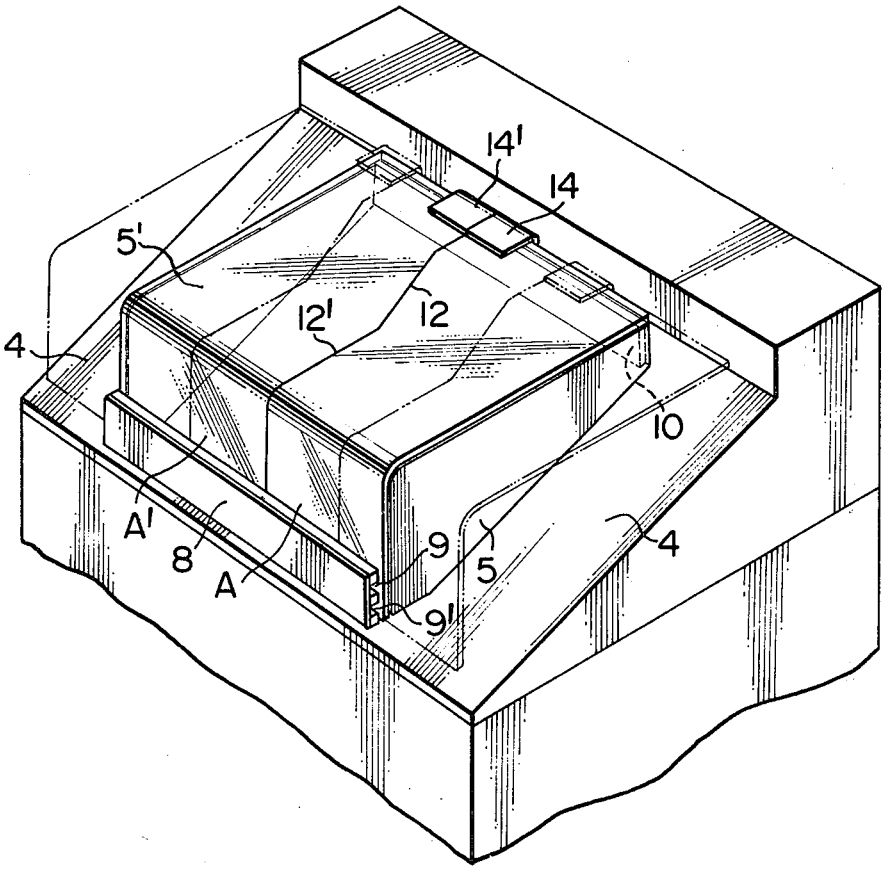
FIG. 1 is a perspective view of the main portion.
Figure 2:
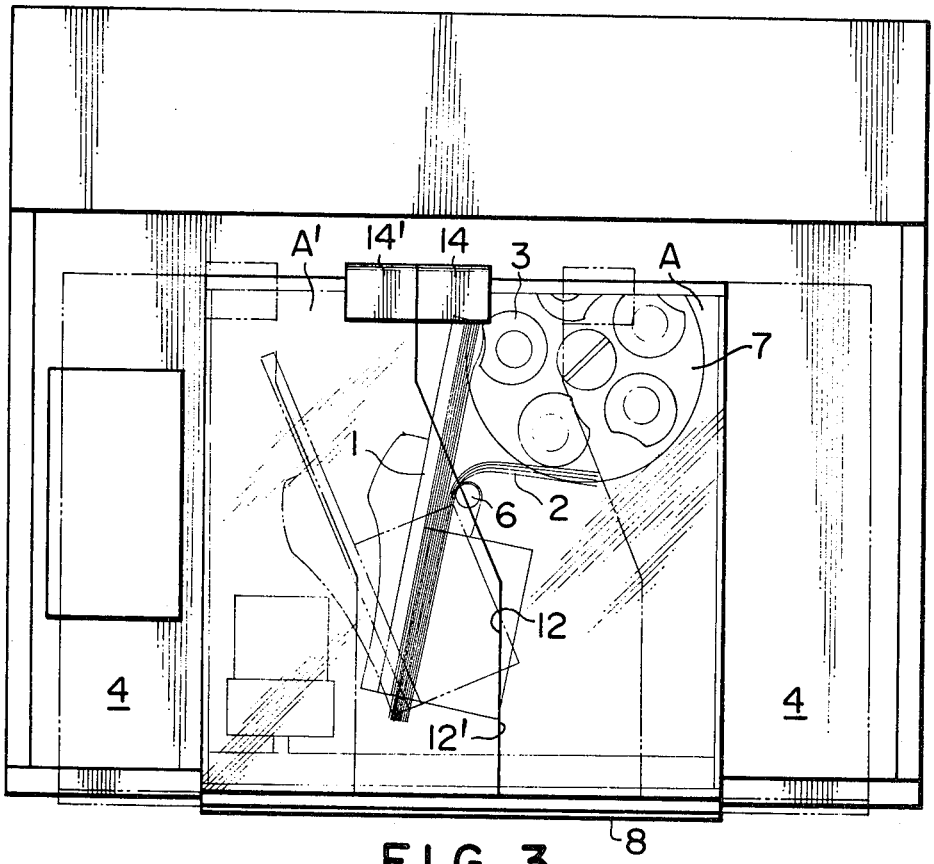
FIG. 2 is a plan view.

FIG. 1 is a perspective view illustrating the upper portion of a note counter, and FIG. 2 is a plan view. A part of an inclined face portion 4 of a machine frame 40 is opened and side plates 5 and 5' are vertically disposed. A counting zone including a holder 1, suction shafts 3, and the like, is formed on a low flat portion in the opening. As in the conventional counter, the holder 1 can turn from the note-attaching position to the counting position, and the number of notes supported by a press lever 6 is counted by turning over the notes one by one by means of the sucking action of suction shafts 3 on a rotary cylinder 7, which suction shafts 3 turn to the counting position, respectively.

Referring to FIGS. 1–5 of the drawings in the lower portion of the opening of the inclined face 4, a guide plate 8 extended in the lateral direction is vertically disposed between the lower ends of the side plates 5 and 5', and an upper guide groove 9 and a lower guide groove 9', each of which is extended in the lateral direction, are formed at upper and lower positions of the inner face of the guide plate 8. In the upper portion of the opening, a guide plate 10 is vertically disposed between the upper ends of the side plates 5 and 5', and a guide groove 11 (FIG. 4) extended in the lateral direction is formed on the outer face of the guide plate 10.

Each of transparent cover members A and A' is bent in an L-figured shape so that one plane is longer than the other plane, and the L-shaped inner faces of both the cover members A and A' correspond to the two sides of the side plates crossing each other at a right angle. The cover members A and A' are arranged so that the inner edges 12 and 12' of the cover members A and A' bear against each other. In the lower portions of the cover members A and A' on the sides of the inner edges 12 and 12', sliding members 13 and 13' are disposed so that they are slidably fitted in the upper and lower guide grooves 9 and 9', respectively. In the upper portions of the cover members A and A' on the sides of the inner edges 12 and 12', L-shaped supporting fittings 14 and 14' are fixed, and rolling wheels 15 and 15' are mounted on the inner faces of the hang-down portions of the supporting fittings 14 and 14' so that the wheels 15 and 15' are slidably fitted in the guide groove 11 (see FIG. 4).

A chain 19 (FIG. 3) is hung from a driving sprocket 16 of a reversible motor M through guide sprockets 17 and 17' and another sprocket 18. The portion of the chain 19 extending from the sprockets 17 and 17' to the sprocket 18 includes two chains along the inner face of the guide plate 8. The upper chain 19 is connected to the cover member A' on the side of the sliding member 13 and the lower chain 19 is connected to the cover member A on the side of the sliding member 13'.

A cam portion 20 is formed on the inner face of the cover member A so that it falls in contact with a position detecting switch 21 fixed in the interior.

The opening distance between the cover members A and A' is arranged so that a bundle 2 (FIGS. 2 and 5) of notes can be attached to or separated from the holder 1.

When the bundle 2 of notes are set to the holder 1, the motor M is started and, at the time of completion of the counting operation, the rotation direction is reversed. The motor M is arranged so that it is stopped when the position detecting switch 21 is actuated.

Figure 3:
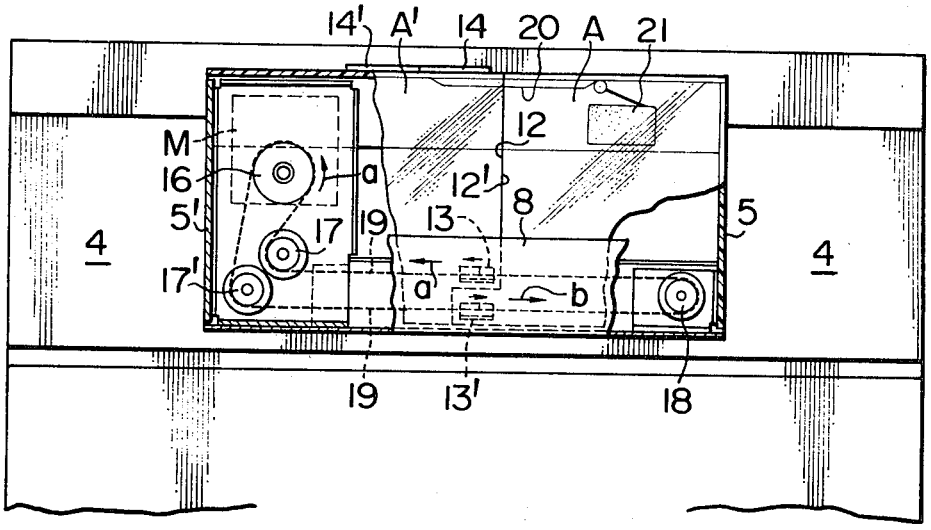
FIG. 3 is a partially cut-out front view.
Figure 4:
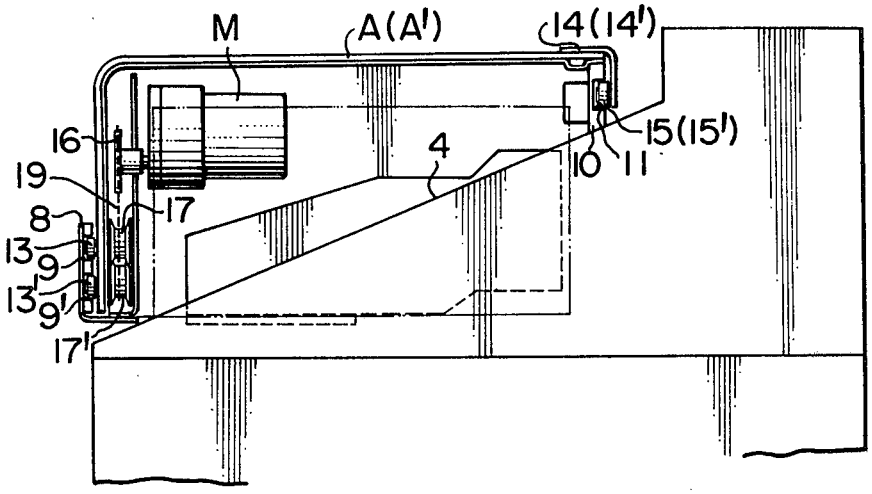
FIG. 4 is a partial side view.

At the beginning of and during the counting operation, as shown in FIGS. 1 to 3, since the inner edges 12 and 12' bear against each other, both the cover members A and A' seal and cover the upper portion of the counting zone, and the intrusion of dust and generation of noise can be prevented. The state of the operation in the interior can be inspected through the cover members A and A'.

When the counting operation is completed, the motor M (FIG. 3) is started so as to turn the chain 19 in a direction of arrow (a). By this turning movement of the chain 19, the sliding members 13 and 13' are moved in the opposite directions of arrow (a) and arrow (b), respectively, and the cover members A and A' are shifted in opposite directions in the state where the sliding members 13 and 13' slide in the upper and lower guide grooves 9 and 9' and the wheels 15' and 15 slide in the guide groove 11. Thus, an opening allowing separation of the bundle 2 of notes is formed between the cover members A and A'. The switch 21 is then actuated to stop the motor M.

Figure 5:
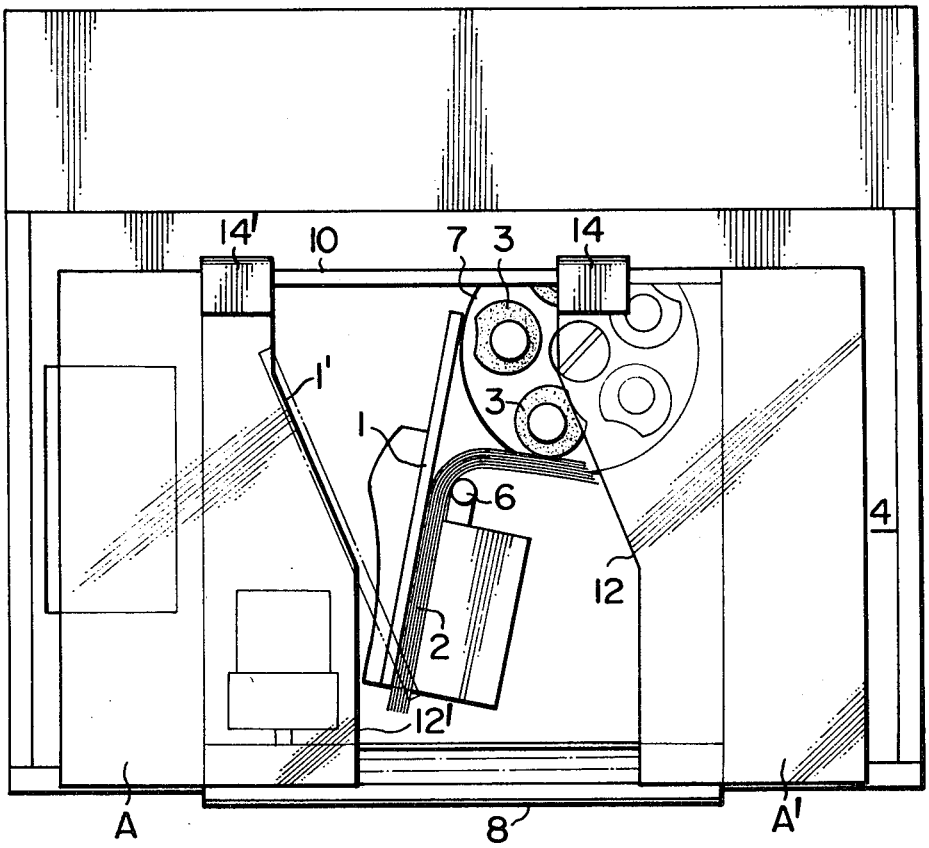
FIG. 5 is a plan view showing the state where the cover is opened.

When a bundle 2 of notes is attached to the holder 1 which is turned to the position indicated by an imaginary line 1' in FIG. 5, the motor M is turned in the reverse direction to bring the cover members A and A' close to each other and to effect covering.

As will be apparent from the foregoing illustration and referring to FIGS. 2 and 5, in a note counter in which the number of a bundle 2 of notes packed in a holder 1 is counted by turning over the notes, one, by one by, means of a plurality of rotary suction shafts 3, according to the present invention, there is provided a cover for the counting zone which comprises two transparent cover members A and A' for covering the upper peripheries of the holder 1 and suction shafts 3 to prevent intrusion of dusts and generation of noises, said cover members A and A' being disposed with capability of being opened so that they can be moved to opposite sides so as to provide an opening for allowing the attachment and separation of the bundle 2 of the notes to and from, respectively, the holder 1. During the counting operation, intrusion of dust and generation of noise can be prevented by closing the cover members A and A', and the counting zone can be inspected through the transparent cover members A and A' to ensure the safety of the operation. Further, the quantity of the movement of the cover members A and A' can be reduced in the portion of the relatively narrow holder 1 and, therefore, the opening and closing operations can be performed smoothly, while diminishing the space for the movement of the cover members A and A'. Furthermore, the structure of the cover can be simplified.

It is obvious that the embodiments of the present invention described hereinabove are merely illustrative and that other modifications and adaptations thereof may be made without departing from the scope of the appended claims.

What is claimed is:

1. In a note counter wherein the number of a bundle of notes packed in a holder is counted, the combination of a frame provided with an open counting zone, a cover for covering the open counting zone, said cover comprising two transparent cover members disposed side by side and each having a front portion and a rear portion, front guide means for guiding each of front portions of said cover members into position, rear guide means for guiding each of rear portions of said cover members into position, and motor drive means for driving said two transparent cover members to move in respective opposite directions, whereby to alternately separate them from each other and join them together, wherein said opening counting zone has a front edge and a rear edge, and said front guide means comprises two vertically disposed grooves laterally extending along the front edge of said open counting zone, said rear guide means comprising one groove laterally extending along the rear edge of said open counting zone, each of said cover members being provided with a slider at the front portion thereof to slidably move in either one or two vertically disposed grooves and a roller at the rear portion thereof to rotatably move in said one groove laterally extending along the rear edge of said open counting zone.

2. In a note counter as recited in claim 3, wherein said frame includes an inclined top surface which is discontinuous so as to form an opening of said counting zone therein, two side plates being provided at the opposite side edges of the counting zone, and said two transparent cover members comprising two plates of L-shaped cross-section and having complementary abutting side edges whereby said two transparent cover members cover and seal said counting zone.

3. In a note counter wherein the number of a bundle of notes packed in a holder is counted, the combination of a frame provided with an open counting zone, a cover for covering the open counting zone, said cover comprising two transparent cover members disposed side by side and each having a front portion and a rear portion, front guide means for guiding each of front portions of said cover members into position, rear guide means for guiding each of rear portions of said cover members into position, and motor drive means for driving said two transparent cover members to move in respective opposite directions, whereby to alternately separate them from each other and join them together, wherein said drive means comprises a motor attached to said frame adjacent to one side of said two transparent cover members, a sprocket attached to said frame adjacent to the other side of said two transparent cover members, and an endless chain driven by said motor through said sprocket, said endless chain being connected at a first portion thereof to a first one of said two transparent cover members and being connected at a second portion thereof to a second one of said two transparent cover members, whereby said two transparent cover members are moved in respective opposite directions.

4. In a note counter as recited in claim 3, wherein said frame includes an inclined top surface which is discontinuous so as to form an opening of said counting zone therein, two side plates being provided at the opposite side edges of the counting zone, and said two transparent cover members comprising two plates of L-shaped cross-section and having complementary abutting side edges whereby said two transparent cover members cover and seal said counting zone.

* * * * *